United States Patent [19]

Trusch

[11] 4,100,003

[45] Jul. 11, 1978

[54] METHOD OF AND APPARATUS FOR PREFORMING METAL OVERLAP EDGE WITH OVERLAP DIE

[75] Inventor: Kenneth Paul Trusch, Phoenix, Ariz.

[73] Assignee: Western Electric Company, Inc., New York, N.Y.

[21] Appl. No.: 733,977

[22] Filed: Oct. 20, 1976

[51] Int. Cl.[2] ..... H01B 13/26

[52] U.S. Cl. ..... 156/54; 156/461

[58] Field of Search ..... 156/48, 50–54, 156/202, 204, 218, 215, 461; 29/728; 228/130, 153, 147, 148, 173

[56] References Cited

U.S. PATENT DOCUMENTS

| | | | |
|---|---|---|---|
| 715,570 | 12/1902 | Friel | 29/728 |
| 946,022 | 1/1910 | Earle et al. | 29/728 |
| 3,433,043 | 3/1969 | Vermeulen | 72/176 |
| 3,575,748 | 4/1971 | Polizzano | 156/54 |
| 3,607,487 | 9/1971 | Biskeborn et al. | 156/47 |
| 3,785,048 | 1/1974 | Peterson | 156/54 X |
| 3,834,010 | 9/1974 | Wolfe et al. | 219/64 X |

FOREIGN PATENT DOCUMENTS

| | | | |
|---|---|---|---|
| 919,405 | 10/1954 | Fed. Rep. of Germany | 228/148 X |

*Primary Examiner*—David A. Simmons

*Attorney, Agent, or Firm*—A. C. Schwarz, Jr.; E. W. Somers

[57] ABSTRACT

The invention relates to the formation of a metallic shield about a cable core to provide a substantially circular configuration of the shield around the core with an overlapped edge portion of the shield, being preformed. The shield is first partially formed about the cable core and thereafter the shield is formed in the substantially circular configuration around the cable core while a portion of the overlying longitudinal edge portion of the shield at the overlap is turned inwardly toward the cable core sufficiently to preclude the edge portion of the shield from protruding disadvantageously into jacket which is subsequently extruded over the shielded cable core.

12 Claims, 20 Drawing Figures

METHOD OF AND APPARATUS FOR PREFORMING METAL OVERLAP EDGE WITH OVERLAP DIE

BACKGROUND OF THE INVENTION

1. Field of the Invention

This invention relates to a method of and apparatus for forming a shield into a tube, and more particularly to a method and apparatus for forming an unjoined metal shield about a strand. Still further, the invention relates to a method and apparatus for forming an unjoined metal shield about a core of a communications cable.

2. Description of the Prior Art

In the manufacture of certain communications cable, primarily for use in telephony, it has been standard practice to enclose the cable core, made up of a plurality of electrical insulated conductors, with an aluminum shield or with combined aluminum and steel shields. The aluminum or the aluminum and steel shields are often corrugated and intermeshed. The prime use of the aluminum shield is for protection against damage to the cable core by lightning, and for shielding against electrical disturbances when installed in the field. The steel shield provides mechanical and rodent protection for the cable core and normally has been soldered or otherwise joined in an overlapped seam, as by the use of an adhesive seam. When the combined metals are used, the steel shield typically is the outer of the two.

The step of soldering, or joining the shield at an overlapping seam, as by an adhesive, has been an expensive operation to perform, as well as requiring added ingredients, such as solder or an adhesive material, with the necessity of added manufacturing apparatus and operations.

However, there had been developed waterproof communications cable, of the type shown in U.S. Pat. No. 3,607,487, issued to M. C. Biskeborn et al on Sept. 21, 1971. The cable shown in the patent is constructed by filling the interstitial spaces in the cable core between insulated conductors with a heated mixture of petroleum jelly and low-density polyethylene and then cooling the compound. In the alternative, a petrolatum compound may be used without the low-density polyethylene. In this construction the cable core will be filled with and surrounded by the waterproofing material, and so it was no longer necessary for the shield to be soldered or the seam thereof joined to form the hermetic seal. Accordingly, it had been proposed that it was no longer necessary to solder the shield or join it at an overlapping seam, but that instead the ends of the metallic shield be overlapped and a tight seam be produced by forming or working of the metal.

In the actual manufacturing of such a cable with an unjoined seam, however, it has been found that there is a tendency for the overlapping outer edge portion of the metallic shield to rebound subsequent to forming and to project outwardly, rather than to be in an adjacent mating relation with the inner edge portion. Thus, the shield and the core tend to form a partially completed cable which have a distorted periphery, which is not circular in configuration, and in which disadvantageously the outer edge of the shield may actually protrude and penetrate or protrude through a final plastic jacket of insulation extruded around the shield. This latter problem appears to occur during the reeling or pay-off of the cable upon or from a reel, and particularly if done in relatively cold surroundings.

Apparatus for forming metal shields with unjoined seams is shown in U.S. Pat. No. 3,785,048 which issued to W. E. Petersen on Jan. 15, 1974. In this patent the outer edge section of the shield was first overformed, after which the overformed edge was reverse-formed by passage through an overlapping die, and subsequently radial inward pressure was exerted on the edge by a forming bar which resulted in the edge section retaining a certain degree of permanent set or deformation. It may be noted that the deformation occurs after the overlapping and closing operation for the seam edges.

SUMMARY OF THE INVENTION

The present invention relates to the formation of a member wherein at least one metal shield is formed into a tube prior to a final jacketing of plastic insulation. More specifically, the metal shield is passed through an overlap and forming die as it is formed into the tube wherein at least a portion of the overlying longitudinal edge protion of the shield at the overlap is turned toward the inner edge portion a distance sufficiently to preclude the edge portion of the tube from protruding disadvantageously into the subsequently extruded jacketing.

Further, the invention relates to the method of and apparatus for causing the overlying longitudinal edge portion of the shield at the overlap to be turned inwardly a distance sufficiently to preclude the edge portion of the tube from protruding into the subsequently extruded jacketing by passing the shield through an overlap and forming die.

BRIEF DESCRIPTION OF THE DRAWINGS

A more detailed understanding of the invention may be had from the following description with reference to the accompanying drawings, in which.

DETAILED DESCRIPTION OF THE INVENTION

Communications cables in general include a plurality of twisted pairs of insulated conductors, which are stranded together to form units, normally consisting of twenty-five pairs. A number of units may then be stranded together to form a cable core, depending on the number of pairs desired in the finished cable.

Figure 1:
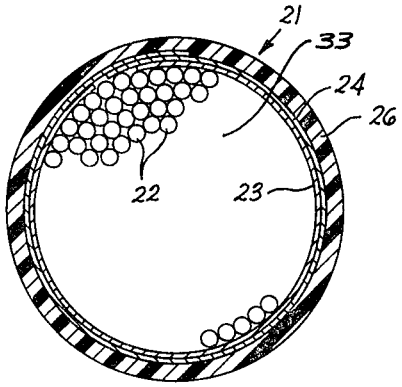
FIG. 1 is a cross-sectional partial view of a completed cable with a joined seam, as known in the prior art.

If reference is made to FIG. 1, there is illustrated in cross-section a prior art type of cable, indicated generally by the numeral 21. The cable 21 includes a plurality of twisted pairs of insulated conductors 22, over which is formed an aluminum inner shield 23. A steel shield 24 is formed over the aluminum shield 23, with an overlapping seam which is joined together, as by soldering. While not shown in the drawing, the two shields 23 and 24 are both corrugated and then intermeshed together prior to being formed over the cable core. A final plastic jacket 26 is then extruded over the outer shield 24.

Figure 2:
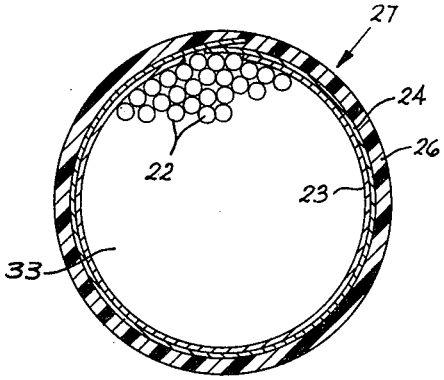
FIG. 2 is a view similar to FIG. 1 but showing the prior art unjoined seam cable with the overlying edge of the metal shield protruding or extending disadvantageously into a subsequently extruded jacket.

FIG. 2 illustrates in cross section a cable, indicated generally by the numeral 27, of the type having an unjoined seam, which may be of the variety in which the cable core is filled with petrolatum compound. However, this view also illustrates the extremity 28 of the outer shield protruding into the outer jacket 26. During installation of the cable 27, this could result in the extremity 28 completely cutting through the jacket 26 thereby permitting the ingress of water to the cable core.

Figure 3:
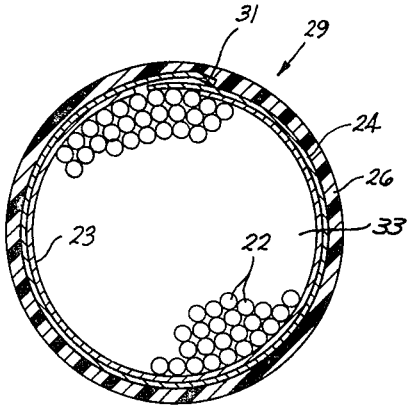
FIG. 3 is a view similar to FIG. 1 showing the cable with the shield as formed in accordance with the instant invention.

If reference is made to FIG. 3, there is illustrated a cable, indicated generally by the numeral 29 having an unjoined seam formed by the longitudinal edge portions of the shields 23 and 24, made in accordance with the present invention. It may be seen that one extremity 31 of the outer shield 24 is turned toward the inner shield 23 and the cable core a distance sufficient to preclude the edge portion of the shield from protruding into the outer jacket 26. This results in a structure which forms a relatively tight seam and overcomes the tendency of the extremity 31 to protrude into (or through) the jacket 26, as illustrated in FIG. 2.

Figure 4:
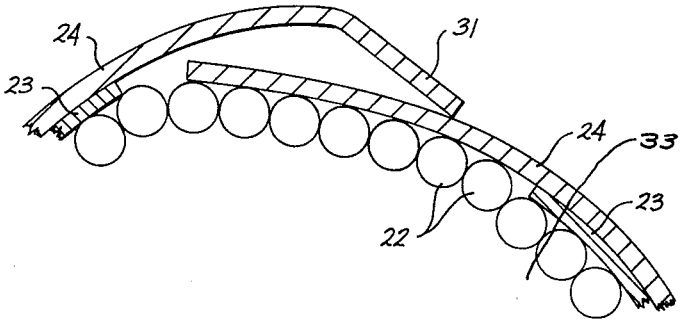
FIG. 4 is a partial enlarged view showing the overlapping unjoined portion of the metal shield formed in accordance with the present invention.

An enlarged view of the seam portion of a cable constructed in accordance with the present invention is shown in FIG. 4, with the extremity 31 of the outer shield 24 at the overlapping seam shown more clearly.

Figure 5:
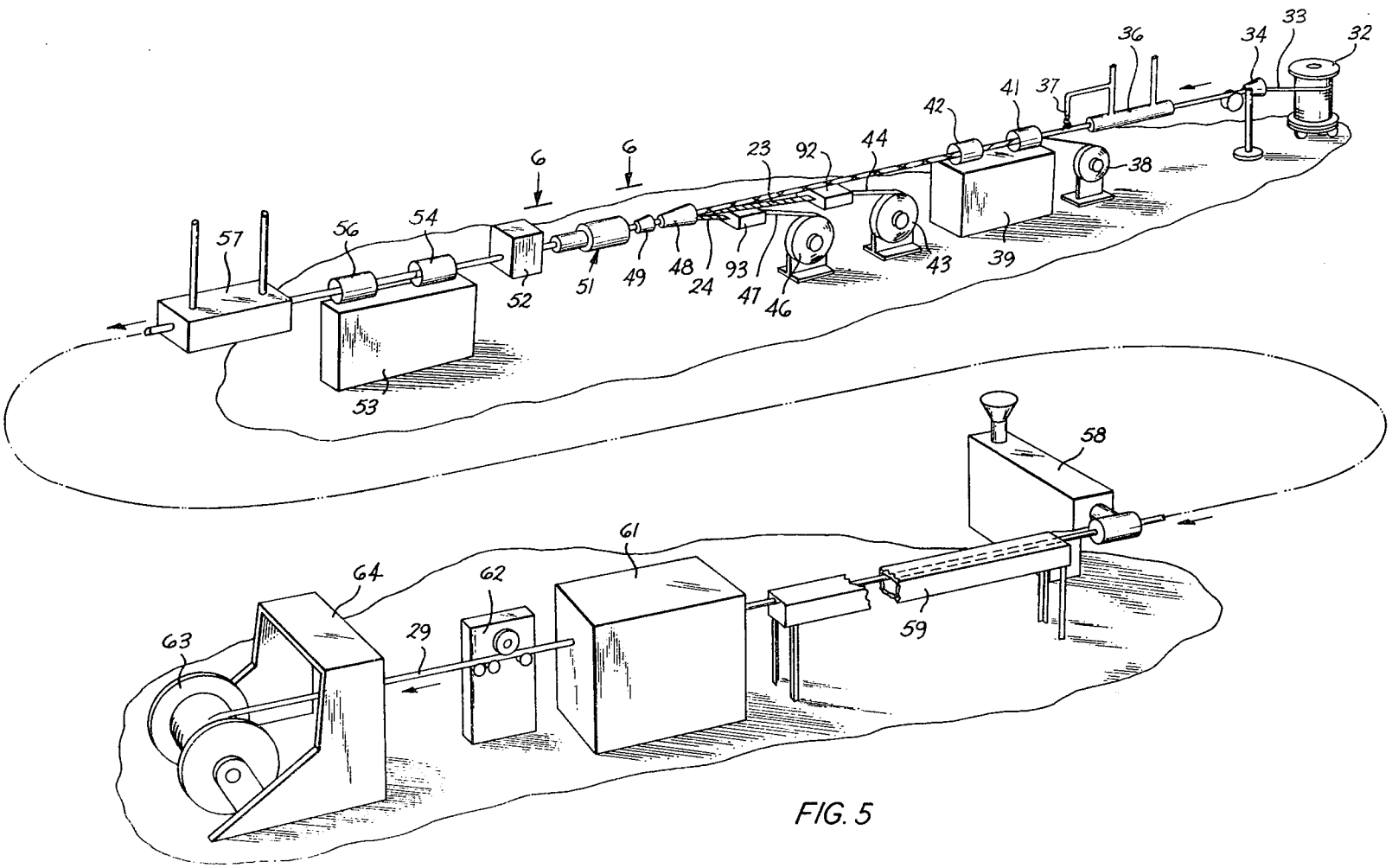
FIG. 5 shows in perspective a manufacturing line for forming the metal shield and a jacket on a cable core.

One method of forming a cable of the present invention is shown in FIG. 5. Starting at the right, a reel 32 of cable core formed of one or more cable units 33 has the unit or units payed off therefrom, in a manner to be later described, through a cable core guide 34. In the following description a single unit 33 will be referred to, but it is to be understood that this may mean a single unit or a plurality of units which form the cable core, depending on the desired cable size.

The unit 33 is then passed through a filling chamber 36, wherein hot petrolatum compound is forced into the interstices between the individual insulated conductors 22—22 forming the unit 33. The filling operation may be of the type disclosed in U.S. Pat. No. 3,876,487, issued to C. E. Garrett et al on Apr. 8, 1975, and incorporated herein by reference.

As the unit 33 leaves the filling chamber 36 a nozzle 37 delivers a small amount of the petrolatum compound to the outer surface of the unit 33. This assures an outer covering of the compound about the unit 33.

A roll 38 of core wrap tape is provided which is longitudinally formed about the unit by a binder 39 in a first binder head 41. The head 41 also wraps spirally a binder thread over the core wrap tape. The binder 39 is provided with a second binder head 42 which wraps spirally a second binder thread about the core wrap tape, but in a direction opposite to the first thread wrap.

A roll 43 of unformed aluminum strip 44 is provided which is placed longitudinally about the bound core wrap in a manner to be later described, to form the shield 23.

Similarly, a roll 46 of unformed steel strip 47 is provided, which is similarly placed longitudinally about the bound core wrap, also in a manner to be described later, to form the shield 24.

The unit 33 and the composite shields 23 and 24 then enter a cone former 48 wherein the shields 23 and 24 are formed partially longitudinally about the unit 33. The cone former 48 may be of the type shown in U.S. Pat. No. 3,874,076, issued to A. Tsukamoto et al on Apr. 1, 1975.

While a single cone former 48 has been disclosed it should be understood that separate cone formers could be used for the aluminum shield 23 and the steel shield 24, after which they would be formed into a composite shield.

While a cone former has been shown in the instant illustrations, it should be understood that formers of various types may be utilized, such as belt formers of the type shown in U.S. Pat. No. 3,785,048, referred to previously.

The partially sheathed unit 33 is then passed through a second cone former 49 where the shields 23 and 24 are further shaped, in a manner to be described later.

The partially shielded unit 33 is then passed through an overlapping and forming die, designated generally by the numeral 51, which will be described in greater detail hereinafter. The die 51 will cause the composite shields 23 and 24 to form an overlapping seam with a formed extremity 31 of the type illustrated in FIGS. 3 and 4, in accordance with the principles of the present invention.

The shielded unit 33 is then passed through a sizing die 52 which forms the composite shields 23 and 24 to the proper size. The sizing die 52 may consist of a plurality of upper depending fingers which force the shielded unit 33 against a substantially semi-circular die, or by a plurality of rollers spaced in proper position about the shielded unit 33, both of which apparatus are known in the art.

The shielded unit 33 is then passed through a second binder 53, wherein a pair of binder heads 54 and 56 spirally wrap individual binder threads about the shielded unit 33, in directions opposite to each other.

The shielded unit 33 is then advanced through a flooding chamber 57, wherein petrolatum compound is flooded about the shielded unit 33 to cover the shielding and the seam thereof. The flooding chamber 57 may be simply an enclosed tank of heated petrolatum compound, under pressure if necessary, and is known in the art.

The flooded shield unit 33 is then advanced through a cross-head extruder 58, well known in the art, wherein the plastic jacket 26, which may be polyethylene, see FIG. 3, is formed about the shield, as a final layer of insulation for the cable 29. The cable 29 is then advanced through a water trough 59, well known in the art, where the jacket 26 is cooled to a temperature to prevent deformation thereof by following manufacturing operations.

The cable 29 is then advanced through a tractor capstan 61. The tractor capstan 61, which is well known in the art, consists of opposed bands of driven caterpillar treads, which serve to advance the cable 29 through the manufacturing line as well as advance the unit 33 from the reel 32.

The cable then passes through a footage counter and marker 62, also well known in the art, and is taken up on a conventional driven take-up reel 63 in a reel stand 64.

Overlapping and Forming Die

The overlapping and forming die 51, referred to previously, is shown in more detail in FIGS. 6 to 12, inclusive.

Figure 6:
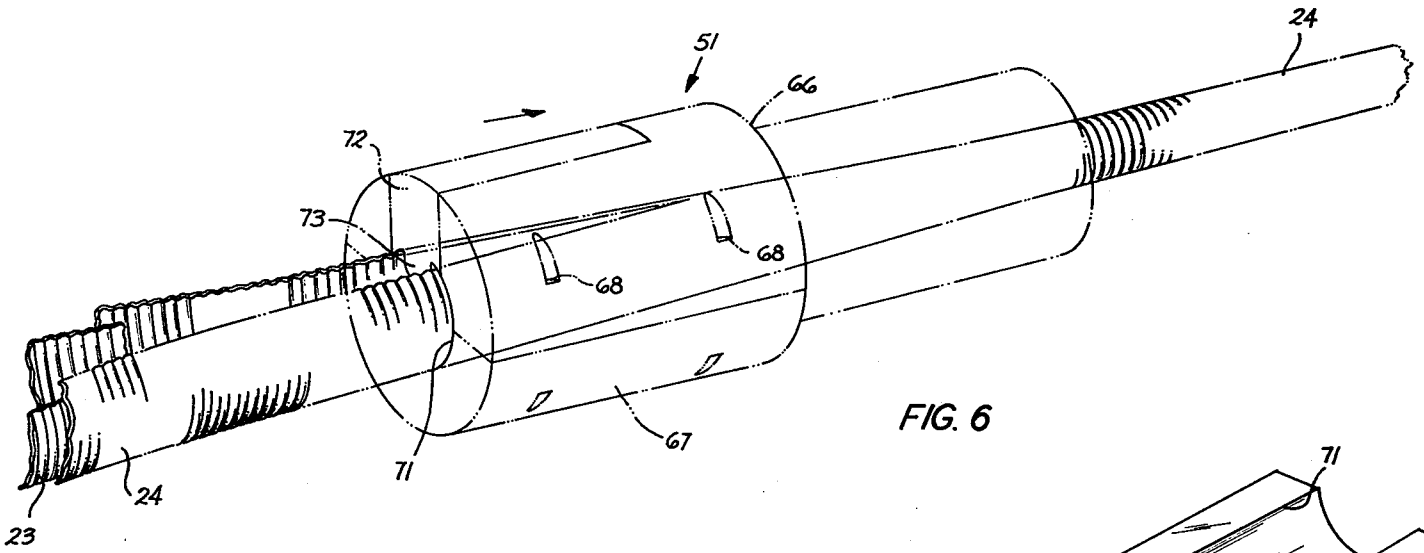
FIG. 6 shows an enlarged overlap and forming die schematically, and is taken substantially on the line 6—6 of FIG. 5 but is reversed 180° therefrom.

The die 51 is shown schematically in FIG. 6 reversed 180° from the manufacturing line position shown in FIG. 5 and illustrates the relative position of the composite intermeshed shields 23 and 24 as they enter and leave the die 51. As may be seen in FIG. 6, the corrugations of the shields 23 and 24 are intermeshed as they come from the second cone former 49 but the U-shaped configuration is not closed, nor do the shields overlap to form a seam.

Figure 7:
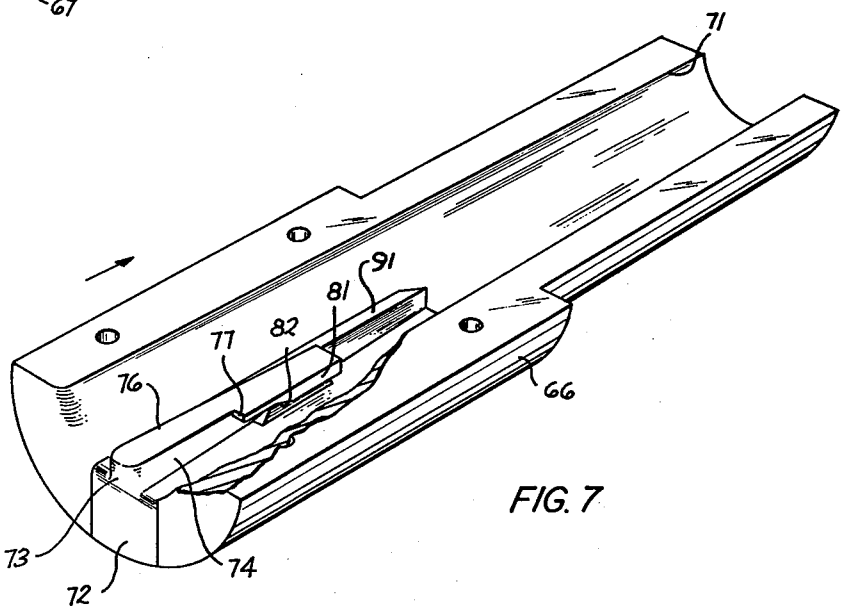
FIG. 7 shows in perspective the top portion of the overlap and forming die of FIG. 6 but rotated 180° and with the bottom portion of the die removed.

The die 51 includes an upper half 66 and a lower half 67 which are held together by set screws 68. The upper half 66 of the die 51 is illustrated in FIG. 7, but rotated 180°, in order to better describe the die 51. While not illustrated in the drawings, the die 51 is held rigidly in position by a die holder.

Figure 8:
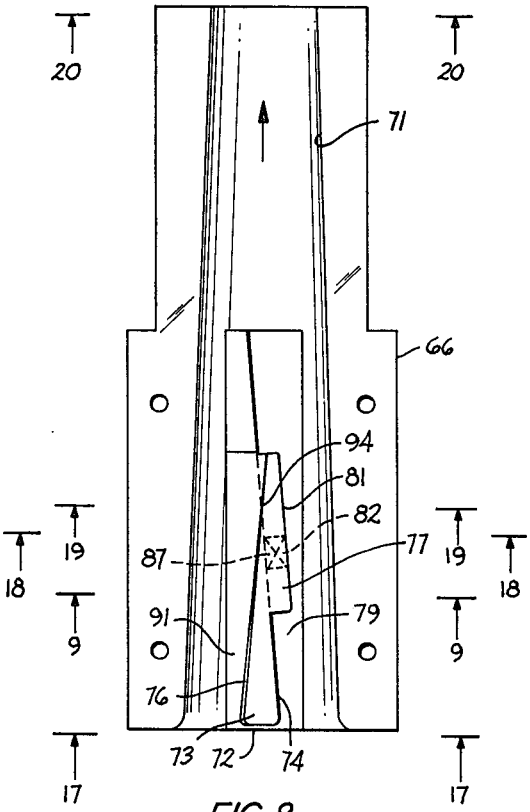
FIG. 8 shows in plan view the top portion of the overlap and forming die of FIG. 7.
Figure 9:
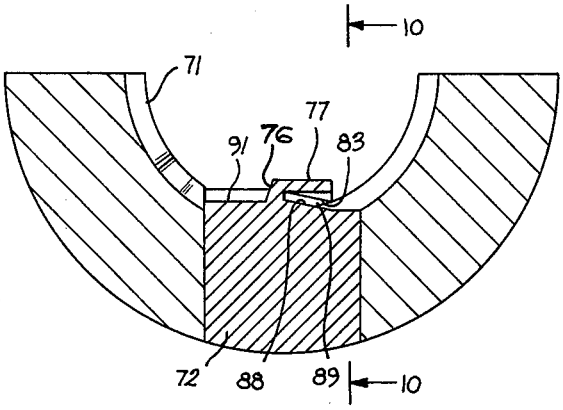
FIG. 9 shows an enlarged cross-sectional view of the top portion of the overlap and forming die taken substantially on the line 9—9 in FIG. 8.

As may be seen in FIG. 6, the die 51 includes an aperture 71 which is tapered along the length of the die, one half of which is shown in FIGS. 7 and 8. As may be seen in FIG. 8, the aperture 71 has the larger cross-section at the entrance end of the die 51. The die 51 is further provided with an insert 72. The insert 72 extends from the entrance end longitudinally for a portion of the die 51, and is located substantially at the mid-portion of the die half 66.

As may be seen in FIGS. 7 and 8, the insert 72 includes a tapered wedge portion 73 which extends into the aperture 71 and forms two side walls 74 and 76. Also as may be seen in FIG. 8 both of the side walls 74 and 76 taper inwardly toward the exit end of the die 51. Also, the side wall 76 is angled slightly outwardly from top to bottom, as may be seen in FIG. 9.

The side wall 74 as it extends inwardly from the entrance end of the die 51 is provided at the upper portion thereof with a portion 77, extending laterally at 90° to the side wall 74. A surface 78 (see FIG. 11) of the portion 77 toward the entrance end of the die 51 extends parallel to, but spaced from a surface 79 of the insert 72 (see FIG. 10).

Figure 10:
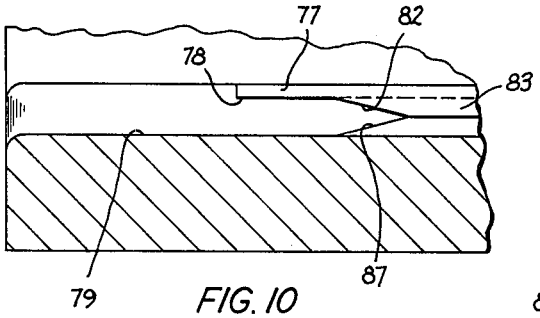
FIG. 10 shows an enlarged partial view of the top portion of the overlap and forming die taken substantially on the line 10—10 of FIG. 9.
Figure 11:
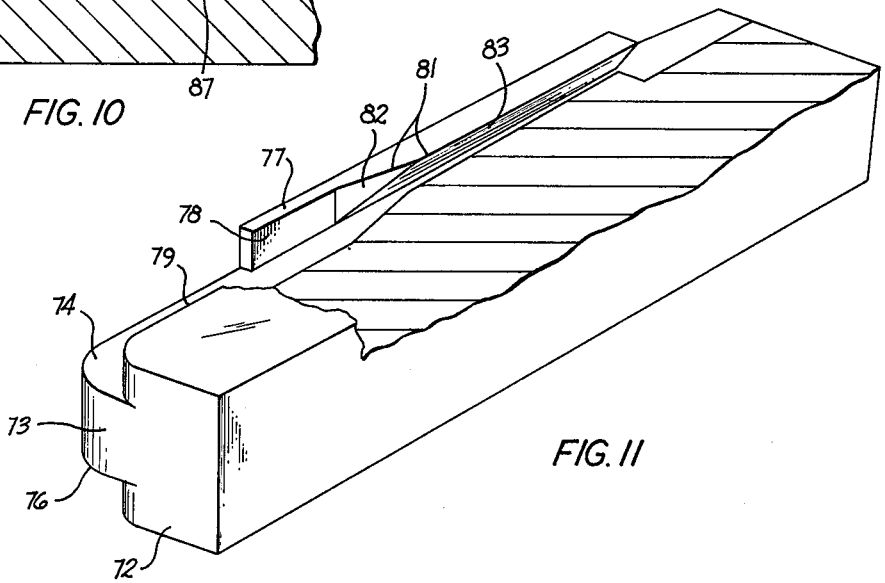
FIG. 11 is an enlarged view of an insert in the top portion of the overlap and forming die, in rotated position, and partly broken away, of FIG. 7.
Figure 12:
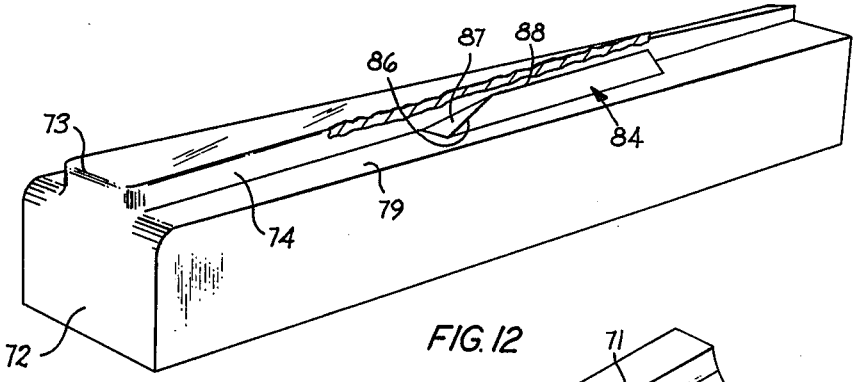
FIG. 12 is another enlarged portion of the insert in the top portion of the overlap and forming die of FIG. 7, with a portion broken away for clarity.

As the surface 78 of the portion 77 extends further toward the exit end of the die 51 it slants toward the side wall 74 and the surface 79 from an outer edge 81 for a short distance to form a surface 82; see FIGS. 10 and 11.

The remainder of the under surface of the portion 77 slants toward the side wall 74 from the outer edge 81 thereof to form a slanted surface 83.

Figure 18:
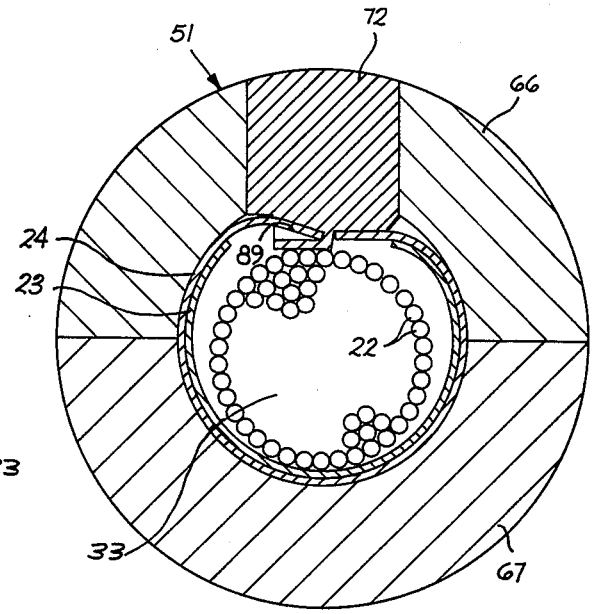
FIG. 18 shows an enlarged view similar to FIG. 17 but taken substantially on the line 18—18 of FIG. 8.

A portion of the surface 79 of the insert 72 is provided with a portion, indicated generally by the numeral 84 (see FIG. 12) which intersects with the side wall 74, and extends substantially the length of the portion 77. The portion 84 adjacent a portion of the surface 82 is bevelled toward the top of the side wall 74 from an outer front edge 86 thereof to form a surface 87. The remainder of the portion 84 is slanted toward the top of the side wall 74 from the outer edge 86 thereof to form a surface 88 parallel to the surface 83 but spaced therefrom a slight amount to form a guideway 89 (see FIG. 9) to receive therebetween the longitudinal edge portions of the cable shields 23 and 24 (see FIG. 18).

Adjacent to the side wall 76 and on the inner surface of the insert 72 there is provided an upstanding portion 91 which extends the length of the insert 72. The portion 91 is bevelled upwardly from the entrance end of the 51 for a distance and then extends the remainder of the length of the insert 72 in a direction parallel to the surface of the aperture 71 but spaced therefrom.

The various portions and surfaces as have been described are for the purpose of causing the shields 23 and 24 to be overlapped to form a seam with the outer edge portion of the shields formed with an extremity, such as the extremity 31 disclosed in FIG. 3. This will be described more in detail in the description of operations, hereinafter.

While a specific embodiment has been disclosed and described it should be understood that this is for particular size cables, having sheaths of specific widths. As examples, the embodiment disclosed is for cables having unformed shield widths of $3\frac{1}{4}$ inches to $9\frac{5}{8}$ inches.

Figure 13:
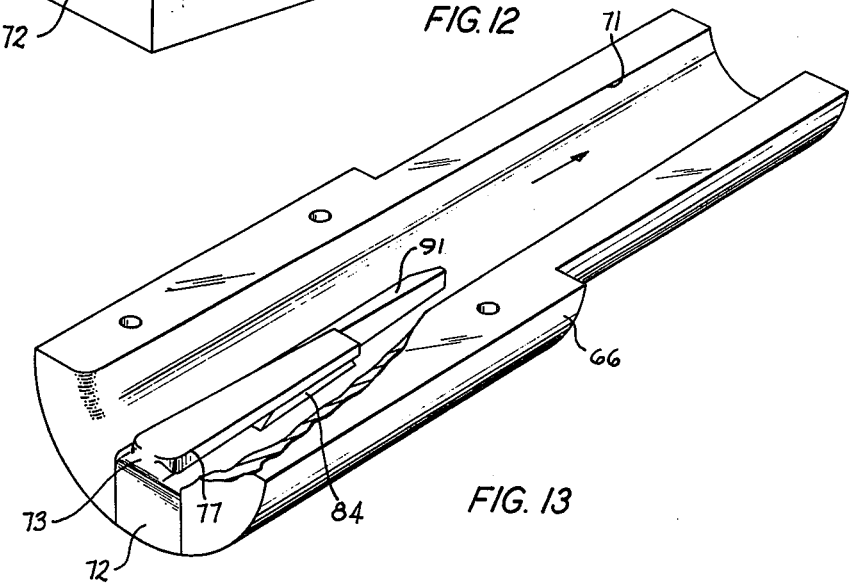
FIG. 13 is a perspective view similar to FIG. 7 but shows an alternate construction of the top portion of the overlap and forming die.

An alternative design for an overlap and forming die 51 is shown in FIG. 13. This design is utilized for cable sizes requiring unformed shield widths of $3\frac{3}{4}$ inches to $3\frac{1}{8}$ inches.

In this latter design the portion 77 extending laterally at 90° to the side wall 74 starts substantially at the entrance end of the die 51, rather than at a point inwards from the entrance end (see FIG. 8). In this embodiment, there is no slanting surface, similar to surface 82 of FIGS. 10 and 11, but instead the slanted surface 83 of FIG. 11 commences at the start of the portion 77.

Otherwise, the various other portions and surfaces described in the first embodiment are the same for the alternative design, but the dimensions thereof may vary.

The prime reason for the differences in the two designs is that when the smaller sized cables were shielded with a narrower width unformed shielding strip, the lengths of the die 51 where shorter than the dies 51 used for the larger sized cable. Such being the case, it is necessary that the portion 77 start at the entrance end of the die 51 in order to provide a sufficient distance of travel of the shields 23 and 24 through the guideway 89 to form the extremity 31.

Conversely, for the larger size cables and wider shielding strips, the die 51 is longer in length, and so the extremity 31 is formed by sufficient travel through the guideway 89 of the die 51 even though the portion 77 starts inwardly of the entrance end of the die 51 (see FIG. 7).

Operation of the Invention

In the following description of the operation of apparatus of the invention, the various operations performed on the cable core or unit 33 through the cone former 49 will be described only briefly as they are all well known in cable manufacture.

As the unformed aluminum strip 44 is advanced from the reel 43 it will be passed through a corrugator 92 to provide corrugations of the necessary width and depth to form the aluminum shield 23.

Similarly, the unformed steel strip 47 advanced from the reel 46 is passed through a corrugator 93 to provide corrugations of the necessary width and depth to form the steel shield 24, so that they will later intermesh with the corrugations in the aluminum shield 23.

Figure 14:
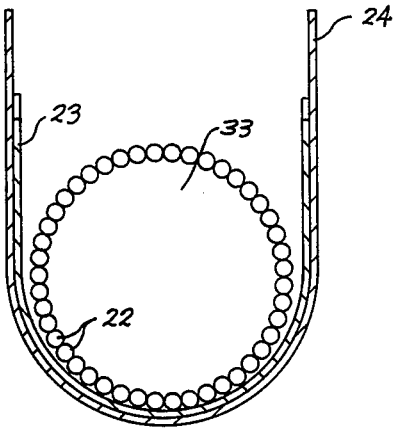
FIG. 14 is a cross-section of the cable core with a composite shield partially formed as they leave a cone former shown in FIG. 5.

The unit 33 and the shields 23 and 24 are then passed through the cone former 48, where the shields 23 and 24 are intermeshed to form a composite shield. Further, the intermeshed shields 23 and 24 are partially formed around the cable core in a substantial U-shaped configuration, as shown in FIG. 14.

Figure 15:
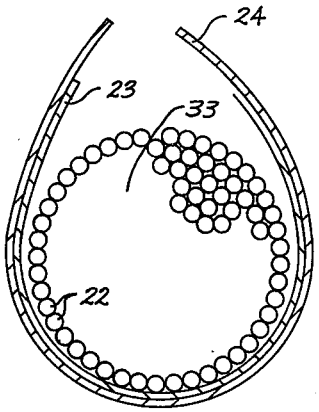
FIG. 15 is a view similar to FIG. 14 with the shield formed further about the cable core as they leave a second cone former shown in FIG. 5.

As the unit 33 with the partially formed shields thereafter pass through the second cone former 49, the U-shaped configuration will be altered so that the free ends of the "U" will be curved and spaced, as shown in FIG. 15, to enter the overlapping and forming die 51.

Figure 17:
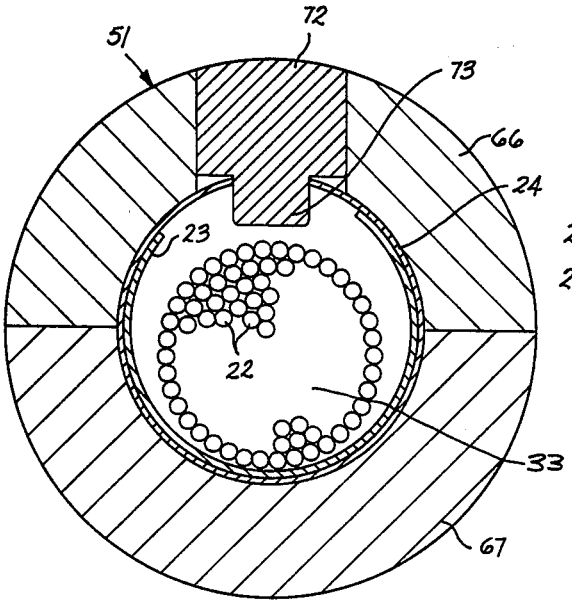
FIG. 17 shows an enlarged view of the overlap and forming die taken substantially on the line 17—17 of FIG. 8, rotated 180°, and with the shield in position therewith and with the bottom portion of the die in place.

As the partially formed cable enters the die 51, the intermeshed shields will take the substantially circular configuration of the aperture 71. If reference is made to FIGS. 9 and 10 it may be understood that the spacing of the free ends of the "U" configured composite shield will be such that the wedge portion 73 of the insert 72 will pass therebetween, with the edges of the shields 23 and 24 abutting or substantially abutting the side walls 74 and 76, as the unit 33 and partially formed shields enter the die 51, as is shown in FIG. 17.

Further advance will cause the composite shield edge adjacent the wall 74 to ride on the tapered portions 82 and 87 and to enter the guideway 89 formed by the surfaces 83 and 88. At this time the edges will still be separated but the extremity 31 will be formed extending toward the unit 33 or cable core; see FIG. 18. Obviously, the guideway 89 must be sufficiently wide to accommodate the composite corrugated shield.

At this time also the edge portion of the shields adjacent the side wall 76 will ride on the portion 91, first in an inclined direction because of the taper and then in a parallel direction with respect to the aperture 71.

Figure 16:
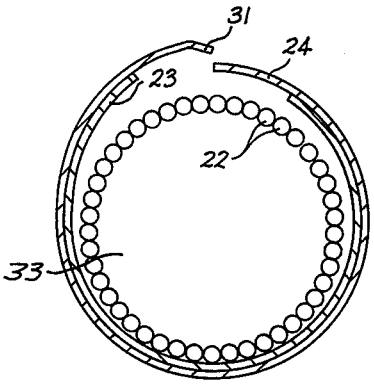
FIG. 16 is a view similar to FIG. 15 but after the shield and cable core have been moved partially through the overlap and forming die shown in FIG. 8.
Figure 19:
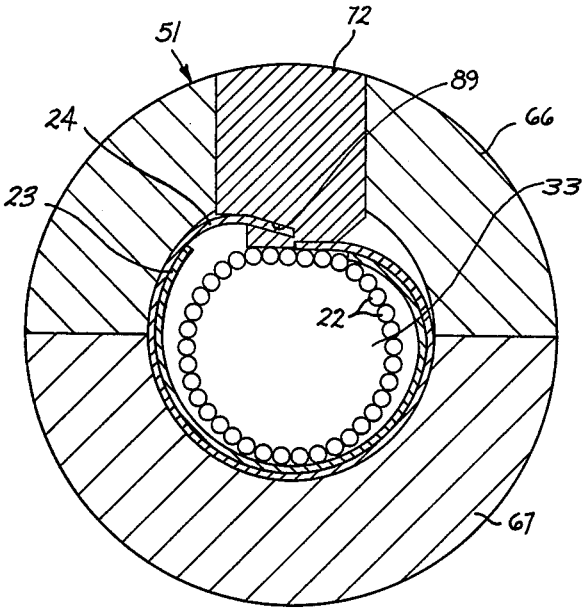
FIG. 19 shows an enlarged view similar to FIG. 17 but taken substantially on the line 19—19 of FIG. 8.

As the radius of the aperture 71 decreases because of the taper of the walls thereof, the edges of the shields will be in alignment at a point 94 in FIG. 8, but at different levels, as shown in FIGS. 16 and 19. This occurs because the edge portion of the shields adjacent the side wall 76 will be riding on the portion 91, whereas the edge portion of the shields adjacent the side wall 74 will be riding in the guideway 89 formed by the surfaces 83 and 88, to take the form shown in FIG. 19.

Figure 20:
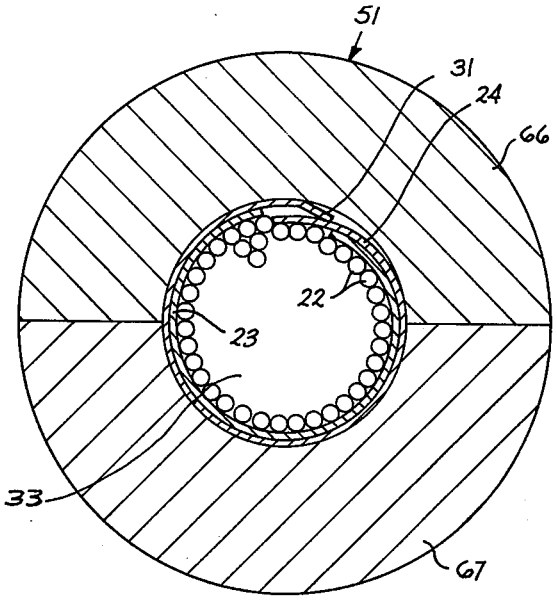
FIG. 20 shows an enlarged view similar to FIG. 17 but taken substantially on the line 20—20 of FIG. 8.

As the partially shielded unit 33 passes beyond the point 94, see FIG. 8, the two edge portions of the shields will start to overlie each other with the edge portion having the extremity 31 being on top of or over the opposite edge portion. Since the aperture 71 continues to taper inwardly and the insert 72 ends, the shielded unit 33 exiting the die 51 will be substantially in the form shown in FIGS. 3 and 20, subject to passage through the sizing die 52.

Thus, it may be understood that the die 51 causes both the formation of the extremity 31, as well as the overlapping of the shield edges to form the seam thereof.

As the shielded unit leaves the die 51 it will be passed through the sizing die 52 where it will be brought to size. Thereafter it will be passed through the binder 53 to receive binder threads thereon, through the flooding chamber 57, through the extruder 58 to receive the jacketing 26 thereon, through the water trough 59, through the footage counter and marker 62 and onto the reel 63.

While the instant invention has been described as having shields of both aluminum and steel it should be understood that it may be utilized if only a single shield were to be used, which has sufficient rigidity to cause rebound or spring-back of the overlapping edge portion, to prevent the edge portion 31 from protruding, as shown in FIG. 2.

Further, the invention has been described in the manufacture of a cable having a filling of petrolatum compound alone or combined with low-density polyethylene. It should be understood that the cable may just as well have no fill material at all therein.

Also, while the invention has been described in the shielding of a cable core, it is believed obvious that the invention could be used in the placing of a metal covering over any tubular member, as well as in the forming of the metal into a hollow tube, the only requirement being that one of the metal edge portions be formed generally as described above.

Although a specific embodiment of the invention has been shown and described, it will be understood that this embodiment is but illustrative and that various modifications may be made therein without departing from the scope and spirit of the invention.

What is claimed is:

1. A method of forming a metallic shield about a cable core to provide a preformed overlap of the shield, which includes the steps of, forming the shield partially about the cable core, passing the partially formed shield and cable core through an overlap and forming die to form the shield about the cable core and to provide the shield with a substantially circular configuration with the longitudinal edge portions of the shield forming an overlap, while at the same time, guiding the longitudinal edge portions of the shield to cause at least a portion of the overlying longitudinal edge portion of the shield at the overlap to be turned inwardly toward the cable core a distance sufficiently to preclude the edge portion of the shield from protruding into a subsequently extruded jacket over the formed shield.

2. The method of claim 1, wherein the step of forming the shield partially about the core includes forming the shield in a substantially U-shaped configuration about the core.

3. Apparatus for forming a metallic shield about a cable core to provide a preformed edge of the shield, which includes, means for forming the shield partially about the cable core, means for forming the shield around the cable core with a substantially circular configuration with the longitudinal edge portions of the shield forming an overlap, and means for guiding longitudinal edge portions of the shield while said last means is forming the circular configuration with overlap, to cause at least a portion of the overlying longitudinal edge portion of the shield at the overlap to be turned inwardly toward the cable core a distance sufficiently to preclude the edge portion of the shield from protruding into a subsequently extruded jacket over the shield.

5. The apparatus of claim 3 wherein said second and third means include an overlap and forming die which is provided with a forming insert which extends from the entrance end of said die in a direction toward the exit end of said die.

6. The apparatus of claim 3 wherein said second and third means include an overlap and forming die which is provided with a forming insert which extends from a position a distance from the entrance end of said die in a direction toward the exit end of said die.

7. The apparatus of claim 3 wherein said second and third means includes an overlap and forming die which is provided with a forming insert for causing the longitudinal overlying edge portion of the shield to be turned toward the cable core, and also for causing the longitudinal edge portions of the shield to overlap.

4. The apparatus of claim 3, wherein the means for forming the shield partially about the core includes means for forming the shield in a substantially U-shaped configuration.

8. The apparatus of claim 7 wherein the insert is provided with a guideway which has one end open and which slants in a direction of the open end toward the cable core for causing the portion of the overlying longitudinal edge portion of the shield to be turned inwardly toward the cable core.

* * * * *